US009857067B2

(12) United States Patent
Allen et al.

(10) Patent No.: US 9,857,067 B2
(45) Date of Patent: Jan. 2, 2018

(54) LED TRACK LIGHTING

(71) Applicants: Matthew Allen, Waterford, WI (US); Thomas Lutz, Cedar Rapids, IA (US)

(72) Inventors: Matthew Allen, Waterford, WI (US); Thomas Lutz, Cedar Rapids, IA (US)

( * ) Notice: Subject to any disclaimer, the term of this patent is extended or adjusted under 35 U.S.C. 154(b) by 0 days.

(21) Appl. No.: 15/626,992

(22) Filed: Jun. 19, 2017

(65) Prior Publication Data

US 2017/0284645 A1 Oct. 5, 2017

Related U.S. Application Data

(63) Continuation of application No. 15/131,624, filed on Apr. 18, 2016, now Pat. No. 9,709,254, which is a (Continued)

(51) Int. Cl.
*F21V 9/00* (2015.01)
*F21V 21/35* (2006.01)
(Continued)

(52) U.S. Cl.
CPC ..... *F21V 21/35* (2013.01); *F21K 9/00* (2013.01); *F21V 21/088* (2013.01); *F21V 23/02* (2013.01);
(Continued)

(58) Field of Classification Search
CPC ..... F21K 9/00; F21V 21/088; F21V 23/02; F21V 23/04; F21V 23/0435; H05B 33/0845; H05B 37/02
(Continued)

(56) References Cited

U.S. PATENT DOCUMENTS 2,988,312 A 6/1961 Dumas
3,660,820 A * 5/1972 Liberman ..... F21V 21/02 362/150
(Continued)

FOREIGN PATENT DOCUMENTS

DE 102011076128 11/2012

OTHER PUBLICATIONS

EcoQube—Desktop Ecosystem That Grows Flowers and Herbs, by Aqua Design Innovations, https://www.kickstarter.com/projects/kevinzl/ecoqube-desktop-ecosystem-that-grow-flowers-and-herbs, Dec. 30, 2013 (25 pages).
(Continued)

*Primary Examiner* — Bryon T Gyllstrom
(74) *Attorney, Agent, or Firm* — Michael Best & Friedrich LLP

(57) ABSTRACT

A light member includes a housing having a top side and a bottom side. The top side faces away from a space to be lit, and the bottom side faces the space to be lit. A lighting control region is disposed on the bottom side of the housing that illuminates the space and has a first control channel, a second control channel, and a neutral channel. A first light-emitting module is electrically connected to the first control channel and the neutral channel and a second light-emitting module is electrically connected to the second control channel and the neutral channel. A switch assembly is coupled to the housing and is operable to selectively deliver power to the first control channel and the second control channel.

20 Claims, 9 Drawing Sheets

Related U.S. Application Data continuation of application No. 14/179,889, filed on Feb. 13, 2014, now Pat. No. 9,353,913.

(60) Provisional application No. 61/764,281, filed on Feb. 13, 2013.

(51) Int. Cl.

| | |
|---|---|
| ***F21V 21/088*** | (2006.01) |
| ***F21V 23/04*** | (2006.01) |
| ***F21K 9/00*** | (2016.01) |
| ***H05B 37/02*** | (2006.01) |
| ***F21V 23/02*** | (2006.01) |
| ***H05B 33/08*** | (2006.01) |
| *F21W 131/308* | (2006.01) |
| *F21W 131/405* | (2006.01) |
| *F21Y 101/00* | (2016.01) |
| *F21W 131/301* | (2006.01) |
| *F21Y 115/10* | (2016.01) |
| *F21Y 113/13* | (2016.01) |

(52) U.S. Cl.

CPC ..... *F21V 23/04* (2013.01); *F21V 23/0435* (2013.01); *H05B 33/0845* (2013.01); *H05B 37/02* (2013.01); *F21W 2131/301* (2013.01); *F21W 2131/308* (2013.01); *F21W 2131/405* (2013.01); *F21Y 2101/00* (2013.01); *F21Y 2113/13* (2016.08); *F21Y 2115/10* (2016.08)

(58) Field of Classification Search

USPC ..... 362/231

See application file for complete search history.

(56) References Cited

U.S. PATENT DOCUMENTS

| | | | | |
|---|---|---|---|---|
| 3,687,110 | A | 8/1972 | Braunhut | |
| 3,805,740 | A | 4/1974 | Hall | |
| 3,828,176 | A | 8/1974 | Goldman et al. | |
| 3,834,351 | A | 9/1974 | Schmidt | |
| 4,688,154 | A | 8/1987 | Nilssen | |
| 4,694,223 | A | 9/1987 | Campolo | |
| 4,720,773 | A | 1/1988 | Ahroni | |
| 4,727,448 | A | 2/1988 | Hanyuda et al. | |
| 4,994,943 | A | 2/1991 | Aspenwall | |
| 5,089,940 | A | 2/1992 | Lanzarone et al. | |
| 5,165,778 | A | 11/1992 | Matthias et al. | |
| 5,211,469 | A | 5/1993 | Matthias et al. | |
| 5,307,762 | A | 5/1994 | Englert | |
| 5,636,919 | A * | 6/1997 | Walker | F21V 19/0085 362/217.14 |
| 5,707,136 | A | 1/1998 | Byers | |
| 5,758,959 | A * | 6/1998 | Sieczkowski | F21S 8/026 362/148 |
| 5,848,837 | A | 12/1998 | Gustafson | |
| 5,873,326 | A | 2/1999 | Davet et al. | |
| 5,915,827 | A | 6/1999 | Wang | |
| 5,927,845 | A | 7/1999 | Gustafson et al. | |
| 5,943,198 | A | 8/1999 | Hirsh et al. | |
| 6,029,604 | A | 2/2000 | de Vosjoli et al. | |
| 6,065,849 | A | 5/2000 | Chen | |
| 6,120,262 | A | 9/2000 | McDonough et al. | |
| 6,166,496 | A | 12/2000 | Lys et al. | |
| 6,184,628 | B1 | 2/2001 | Ruthenberg | |
| 6,187,394 | B1 | 2/2001 | Johnson et al. | |
| 6,211,626 | B1 | 4/2001 | Lys et al. | |
| 6,523,976 | B1 | 2/2003 | Turnbull et al. | |
| 6,577,080 | B2 | 6/2003 | Lys et al. | |
| 6,673,292 | B1 | 1/2004 | Gustafson et al. | |
| 6,781,329 | B2 | 8/2004 | Mueller et al. | |
| 6,921,182 | B2 | 7/2005 | Anderson, Jr. et al. | |
| 6,967,448 | B2 | 11/2005 | Morgan et al. | |
| 7,024,814 | B1 | 4/2006 | McDougle | |
| 7,132,804 | B2 * | 11/2006 | Lys | H05B 33/0803 315/292 |
| 7,185,997 | B2 | 3/2007 | Simoni | |
| 7,187,141 | B2 | 3/2007 | Mueller et al. | |
| 7,220,018 | B2 | 5/2007 | Crabb et al. | |
| 7,221,104 | B2 | 5/2007 | Lys et al. | |
| 7,258,459 | B2 | 8/2007 | Wang | |
| 7,307,391 | B2 | 12/2007 | Shan | |
| 7,427,840 | B2 | 9/2008 | Morgan et al. | |
| 7,436,134 | B2 | 10/2008 | Levine | |
| 7,453,217 | B2 | 11/2008 | Lys et al. | |
| 7,473,008 | B2 | 1/2009 | Crabb et al. | |
| 7,482,764 | B2 | 1/2009 | Morgan et al. | |
| 7,500,776 | B1 | 3/2009 | Buczko | |
| 7,503,778 | B2 | 3/2009 | Lehman et al. | |
| 7,543,952 | B1 | 6/2009 | Chang | |
| 7,815,341 | B2 * | 10/2010 | Steedly | F21V 19/0055 362/217.01 |
| 7,845,814 | B2 | 12/2010 | Crabb et al. | |
| 7,878,674 | B2 | 2/2011 | Crabb et al. | |
| 7,946,729 | B2 | 5/2011 | Ivey et al. | |
| D646,002 | S | 9/2011 | Wang | |
| D646,003 | S | 9/2011 | Wang | |
| 8,057,060 | B2 | 11/2011 | Fredricks | |
| 8,100,087 | B2 | 1/2012 | Fredricks | |
| 8,115,411 | B2 | 2/2012 | Shan | |
| 8,222,833 | B2 | 7/2012 | Lin | |
| 8,230,815 | B2 | 7/2012 | Fredricks | |
| 8,232,745 | B2 | 7/2012 | Chemel et al. | |
| 8,256,924 | B2 | 9/2012 | Simon et al. | |
| 8,299,695 | B2 | 10/2012 | Simon et al. | |
| D690,839 | S | 10/2013 | Wang | |
| D690,847 | S | 10/2013 | Wang | |
| 2005/0169015 | A1 | 8/2005 | Luk et al. | |
| 2005/0254263 | A1 | 11/2005 | Harwood | |
| 2007/0253196 | A1 | 11/2007 | Ormiston | |
| 2009/0086478 | A1 * | 4/2009 | Sanroma | A47F 3/001 362/234 |
| 2013/0044469 | A1 | 2/2013 | Crimi et al. | |
| 2013/0063963 | A1 * | 3/2013 | Riesebosch | F21V 21/34 362/555 |
| 2013/0155672 | A1 * | 6/2013 | Vo | F21S 8/00 362/233 |

OTHER PUBLICATIONS

Office Action and English translation from the German Patent and Trademark Office for Application No. 202014100627.3 dated Sep. 1, 2014 (10 pages).

* cited by examiner

LED TRACK LIGHTING

CROSS-REFERENCE TO RELATED APPLICATIONS

This application is a continuation application of U.S. application Ser. No. 15/131,624, filed Apr. 18, 2016, which is a continuation application of U.S. application Ser. No. 14/179,889, filed Feb. 13, 2014, and claims priority to U.S. Provisional Application No. 61/764,281, filed Feb. 13, 2013, the entire contents of each of which are incorporated herein by reference.

BACKGROUND

The present invention relates to aquarium lighting. More particularly, the present invention relates to aquarium lighting using LEDs.

Residential aquarium keeping is a mature and established industry in the United States and around the world. A basic version of an aquarium includes a transparent container for aquatic life to be viewed and housed within. These containers are typically constructed of either glass or a transparent plastic material such as acrylic or polystyrene, but may be made of other transparent or semi-transparent materials. Basic aquatic environments of this nature are limited in their ability to sustain suitable conditions and water quality for all but a handful of robust and hearty fish. Often more appropriate for the health and well-being of the aquatic organisms is the addition of filtration, lighting, oxygenation, temperature control, chemical and biological balance.

SUMMARY

In accordance with one construction, a light member includes a housing having a top side and a bottom side, the top side facing away from an interior of the aquarium, and the bottom side facing the interior of the aquarium. The light member also includes a lighting control region disposed on the bottom side of the housing. The lighting control region includes a first control channel associated with a first color of light, a second control channel associated with a second color of light, and a neutral channel, the lighting control region being sized to receive one or more light-emitting modules. The light member also includes a switch coupled to the housing, the switch operable to control the first control channel.

In accordance with another construction, a light member includes a housing having a top side and a bottom side, and a lighting control region disposed on the bottom side of the housing. The lighting control region includes a first control channel, a second control channel, and a neutral channel disposed therein. The light member also includes a first light-emitting module sized and configured to be coupled to the lighting control region, the first light-emitting module having an LED that emits a first color of light, the first light-emitting module further having a first electrical connector that couples to the first control channel. The light member also includes a second light-emitting module sized and configured to be coupled to the lighting control region, the second light-emitting module having an LED that emits a second color of light, the second light-emitting module further having a second electrical connector that couples to the second control channel.

In yet another construction, a light member includes a housing having a top side and a bottom side. The top side faces away from a space to be lit, and the bottom side faces the space to be lit. A lighting control region is disposed on the bottom side of the housing that illuminates the space and has a first control channel, a second control channel, and a neutral channel. A first light-emitting module is electrically connected to the first control channel and the neutral channel and a second light-emitting module is electrically connected to the second control channel and the neutral channel. A switch assembly is coupled to the housing and is operable to selectively deliver power to the first control channel and the second control channel.

DETAILED DESCRIPTION

Figure 1:
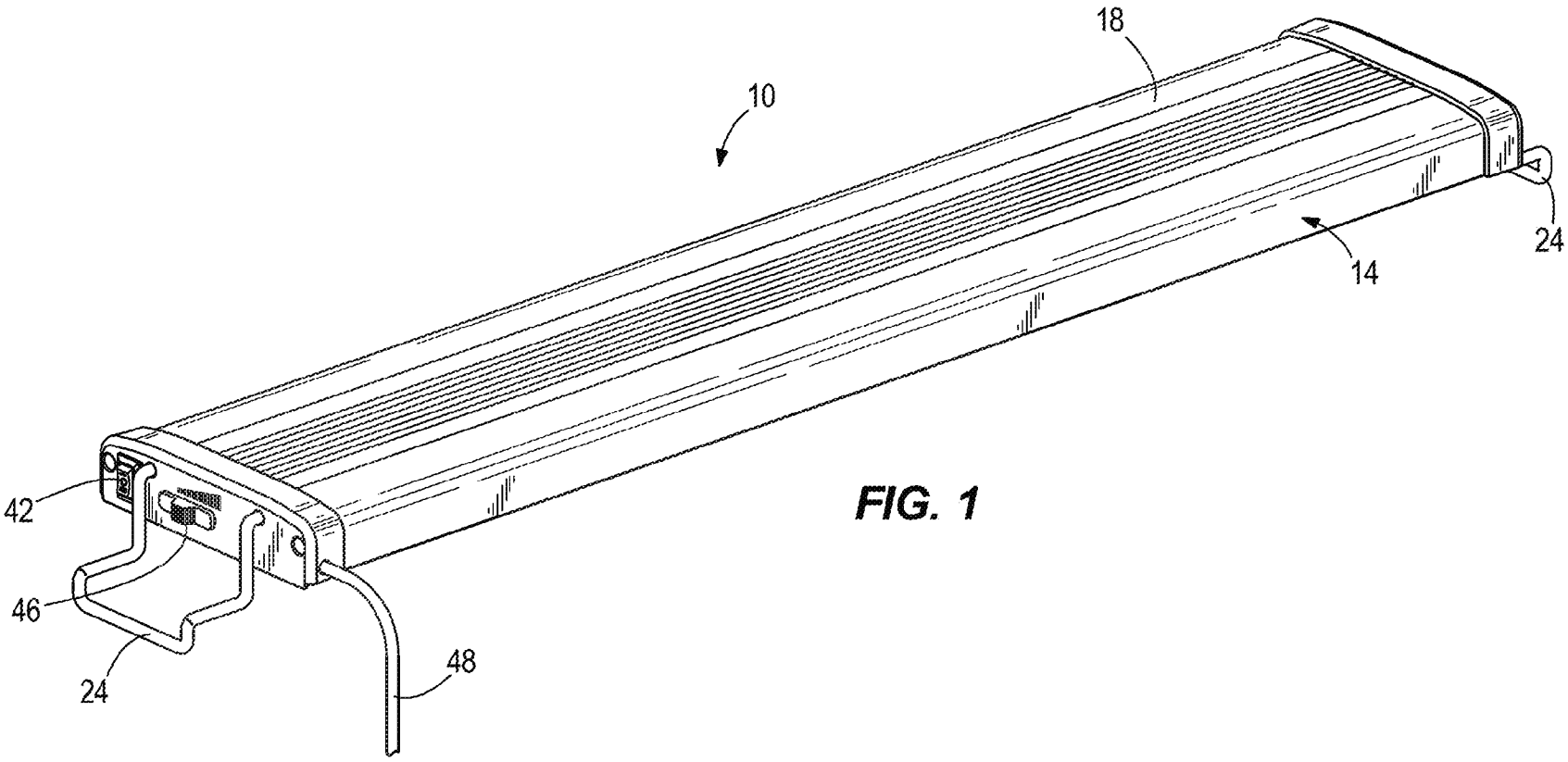
FIG. 1 is a perspective view of a light member according to one construction.
Figure 2:
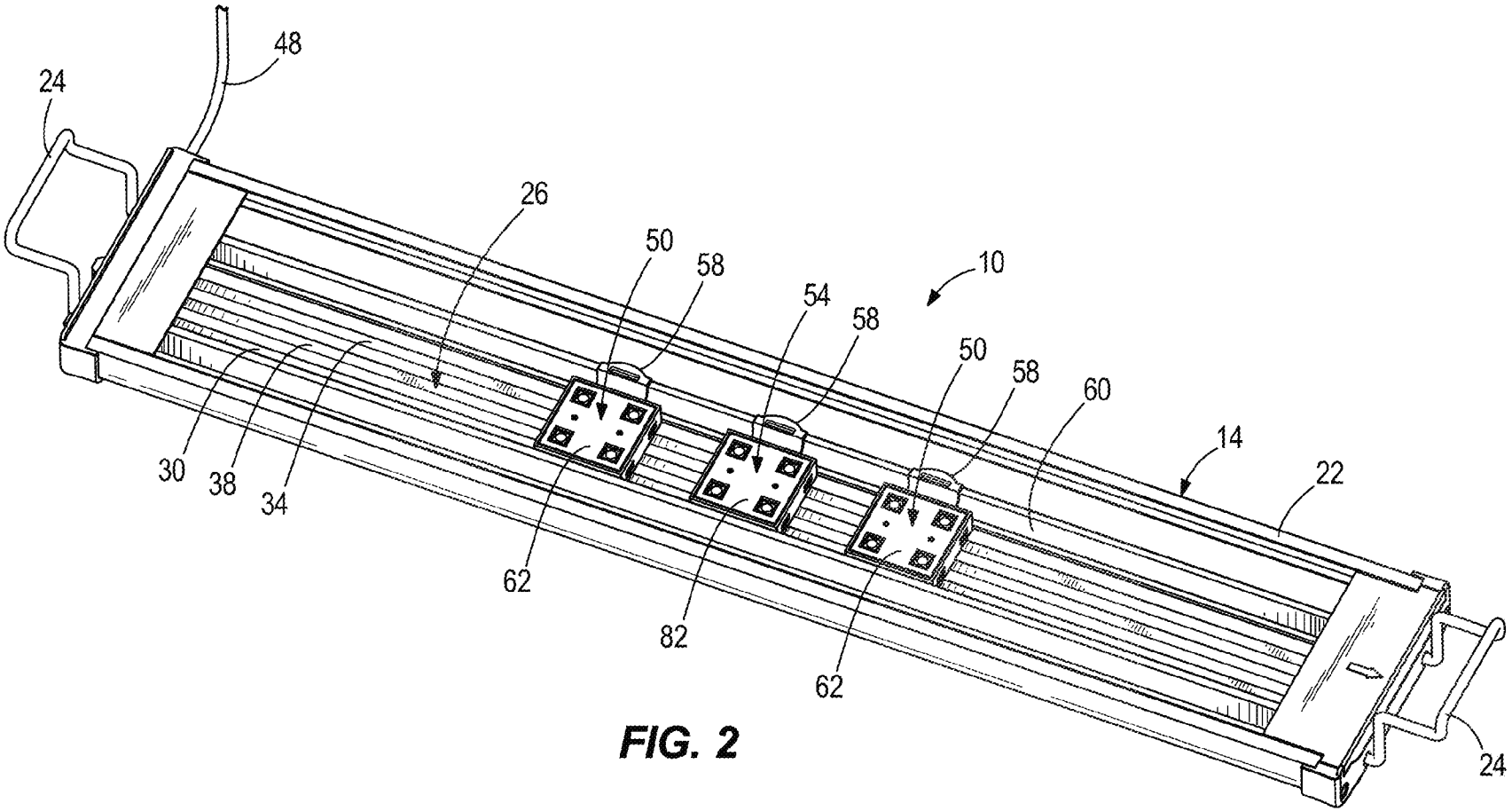
FIG. 2 is a perspective view of the light member of FIG. 1, illustrating a lighting control region along a bottom of the light member.
Figure 3:
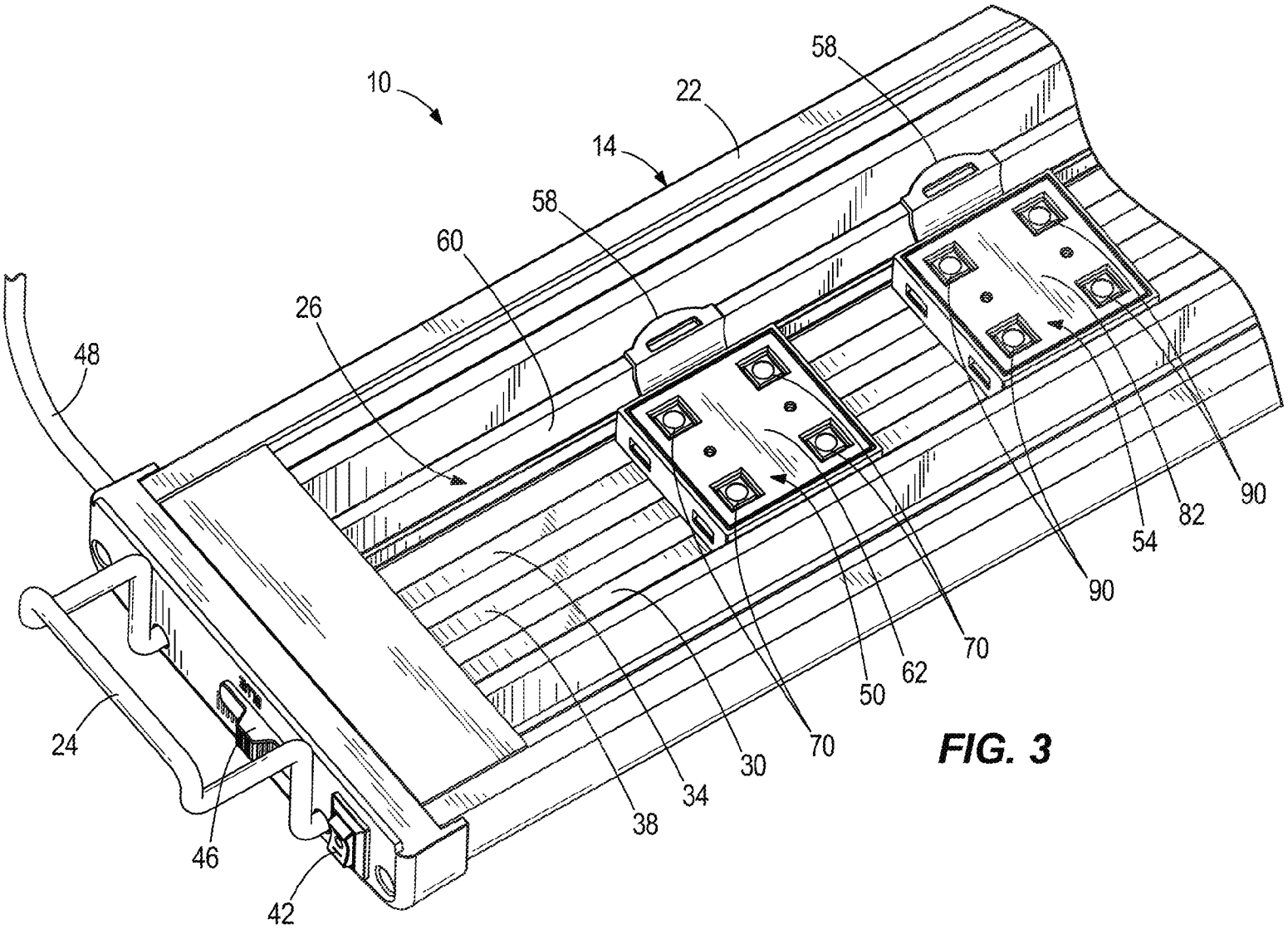
FIG. 3 is an enlarged perspective view of the lighting control region.

FIGS. 1-3 illustrate a light member 10 that includes a housing 14 having a top side 18 and a bottom side 22. The housing 14 is an elongate, generally rectangular component sized and configured to fit over and couple to another structure such as an aquarium. When coupled to an aquarium, the top side 18 faces up and away from an interior of an aquarium, and the bottom side 18 faces down and into the interior of the aquarium to provide lighting inside the aquarium. As illustrated in FIGS. 1 and 2, the housing 14 includes clips 24 for releasably coupling the housing 14 to the aquarium. Other constructions include different structures for coupling the housing 14 to the aquarium or to another structure. In some constructions the housing 14 has other shapes and sizes than that illustrated.

With reference to FIGS. 2 and 3, the bottom side 22 includes a lighting control region 26. In the illustrated construction the lighting control region 26 includes a groove that extends generally linearly in an elongate direction along the bottom side 22, and includes a first control channel 30, a second control channel 34, and a third, neutral channel 38 disposed therein. The third channel 38 is disposed between the first and second channels 30, 34. The first and second channels 30, 34 are control channels for controlling two different sets of light within the aquarium. In the illustrated construction the channel 30 controls white light, and the channel 34 controls blue light. While the illustrated light member 10 includes two control channels, in other constructions more than two control channels (e.g., three, four, five, ten, twenty, etc.) are used.

Each of the control channels 30, 34 can be controlled independently of the other control channel 30, 34. In the illustrated construction, the control channel 30 is used primarily as a "daylight" channel for emitting higher intensity white light, while the control channel 34 is used primarily as a "night" channel for emitting lower intensity blue light. With reference to FIGS. 1 and 3, the light member 10 includes a switch 42 on the housing 14 that is coupled to the control channel 30, and a switch 46 on the housing 14 that is coupled to the control channel 34. The switch 42 is an on/off switch, and the switch 46 is a dimmer style on/off switch. Of course, the switch types could be reversed or both switches could be on/off switches or dimmer switches as may be desired. In some constructions a single switch is used instead of the two switches 42, 46. In another construction, a three way switch is employed to allow a single switch to control both channels 30, 34. In the three way switch construction, the switch is typically arranged with a first position in which neither channel 30, 34 received power. The switch is then movable to a second position in which power is delivered only to the first channel 30 or a third position in which power is delivered only to the second channel 34. In a preferred arrangement, the switch is arranged with a middle position corresponding to the first position, The switch is then movable in opposite directions to the second position or the third position.

A single power cord 48 is coupled to the housing 14 to provide electrical power to both the control channel 30 and the control channel 34. In some constructions the light element 10 also includes a built-in transformer.

Use of the two control channels 30, 34 to control white and blue light enables an end user to define a color temperature output of the aquarium. If the control channel 30 is a relatively warm color temperature, by adding blue light from the control channel 34 with the dimmer switch 46 the user is able to modify a blended color temperature, making the blended color temperature bluer and therefore cooler. It should be noted that while a blue light is described herein, virtually any other color could also be provided. For example, the light could be red, green, yellow, or virtually any other color desired.

In the illustrated construction, the blended color temperature is adjustable between a range of 3500K to 15,000K. In some constructions the temperature is adjustable between 5000K to 12,000K. Other constructions include different temperature ranges. When the control channel 30 is turned off, the control channel 34 functions to provide a night mode for the aquarium. This two channel design enables variable functionality and output options in a small and focused footprint (i.e., within the lighting control region 26), which is a desirable feature in aquarium lighting. In this way, a broad range of user functionality is built into a simple, manually controllable design.

With reference to FIGS. 2-8, the light member 10 also includes one or more light-emitting modules 50, 54 that are releasably coupled to the lighting control region 26 and to one of the channels 30, 34, to emit the white or blue light. The modules 50, 54 can be positioned anywhere along the lighting control region 26. A single module 50, 54, or multiple modules 50, 54, may be added to or removed from the light member 10 at various locations along the lighting control region 26 as desired. As illustrated in FIGS. 2-8, each of the modules 50, 54 includes a tab 58 that releasably couples the modules 50, 54 to a protrusion 60 on the lighting control region 26. Other constructions include different structures to releasably couple the modules 50, 54 to the lighting control region 26. However, the tab 58, or other structure are preferably arranged so that the light-emitting modules can only be installed into the lighting control region 26 in one orientation. The tab 58 is formed as part of the module 50, 54 and includes a living hinge that allows for movement of the tab 58 with respect to the remainder of the module 50, 54. When the tab 54 is depressed toward the remainder of the module 50, 54 the user is able to insert, remove, or move the module 50, 54 along the lighting region 26. When the tab 54 is released, the living hinge biases the tab 54 into engagement with the protrusion 60 to firmly retain the module 50, 54 in the desired position and in electrical contact with one or both of the channels 30, 34 and the neutral 38.

Figure 5:
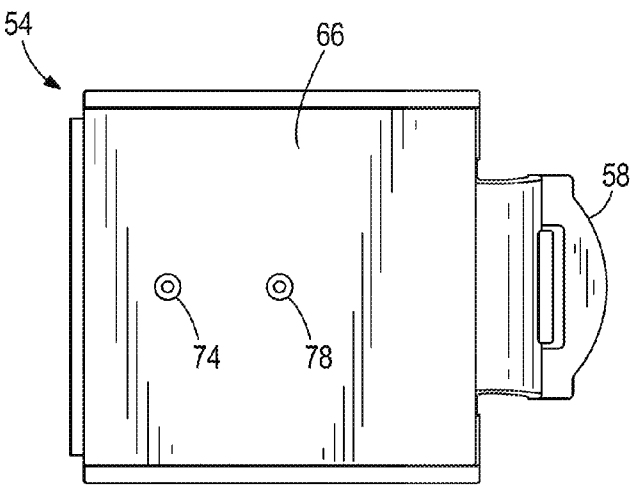
FIG. 5 is a top view of the light-emitting module of FIG. 4, illustrating two electrical connectors.
Figure 4:
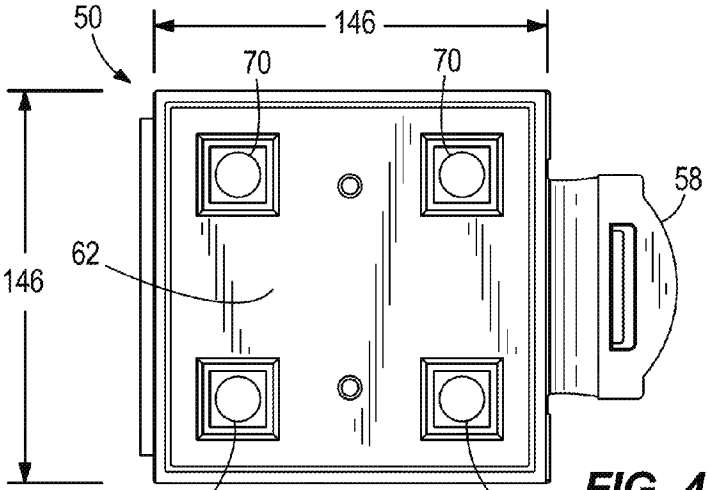
FIG. 4 is a bottom view of a light-emitting module according to one construction.

With reference to FIGS. 4 and 5, in the illustrated construction each of the modules 50 includes a bottom side 62 that faces the interior of the aquarium, and a top, connection side 66 that faces the lighting control area 26. Four LEDs 70 are disposed along the bottom side 62. In some constructions, different numbers and positions of LEDs 70 are arranged along the bottom side 62. In some constructions, the modules 50 have shapes other than that illustrated. The four LEDs 70 of the module 50 are configured to emit white light with other colors being possible.

With reference to FIG. 5, the connection side 62 of the module 50 includes a first electrical connector 74 and a second electrical connector 78. When the module 50 is coupled to the lighting control area 26, the first electrical connector 74 couples to the control channel 30, and the second electrical connector 78 couples to the neutral channel 38, to provide electrical power through the channel 34 to the module 50 and the LEDs 70. The electrical connectors 74, 78 are metal tabs disposed along the connection side 66 that extend outward slightly to engage the channels 30, 38 and form electrical connections.

Figure 7:
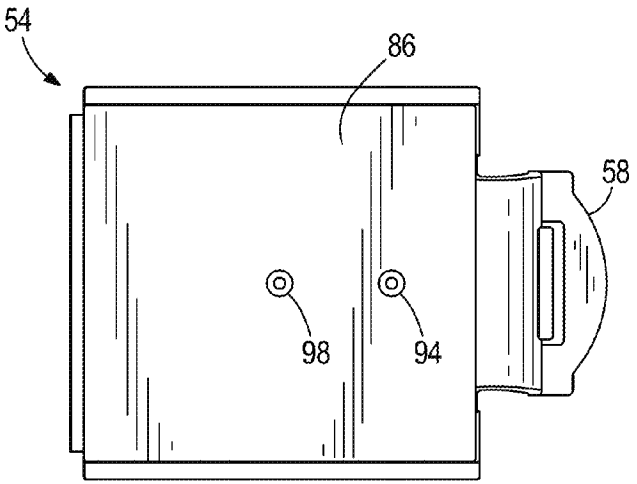
FIG. 7 is a top view of the light-emitting module of FIG. 6, illustrating two electrical connectors.
Figure 6:
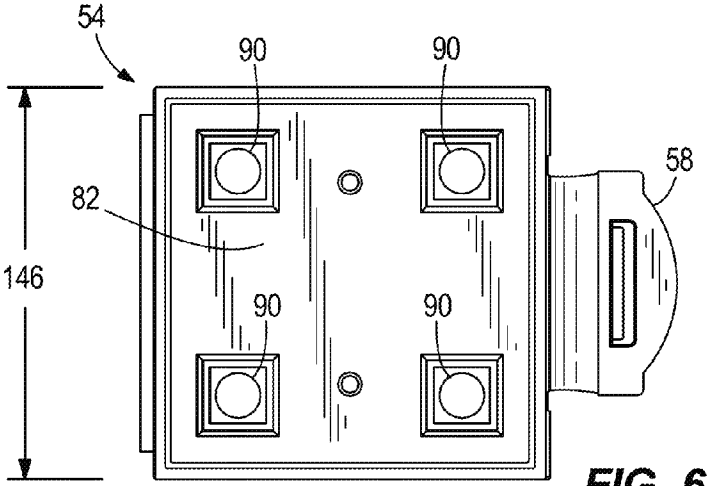
FIG. 6 is a bottom view of a light-emitting module according to another construction.

With reference to FIGS. 6 and 7, in the illustrated construction each of the modules 54 includes a bottom side 82 that faces the interior of the aquarium, and a top, connection side 86 that faces the lighting control area 26 when coupled to the light member 10. Four LEDs 90 are disposed along the bottom side 82. In some constructions different numbers and positions of LEDs 90 are arranged along the bottom side 82. In some constructions the modules 54 have shapes other than that illustrated. The four LEDs 90 of the module 54 are configured to emit blue light.

With reference to FIG. 7, the connection side 86 of the module 54 includes a first electrical connector 94 and a second electrical connector 98. When the module 54 is coupled to the lighting control area 26, the first electrical connector 94 couples to the control channel 34, and the second electrical connector 98 couples to the neutral channel 38, to provide electrical power through the channel 34 to the module 54 and the LEDs 90. The electrical connectors 94, 98 are metal tabs disposed along the connection side 86 that extend outward slightly to engage the channels 34, 38 and form electrical connections.

As illustrated in FIGS. 5 and 7, the electrical connector 74 is disposed farther away from the tab 58 than the electrical connector 94. This arrangement, in combination with the arrangement of the light-emitting module that only allows installation in one orientation assures that the connector 74 is only able to electrically connect to the channel 30.

Figure 8:
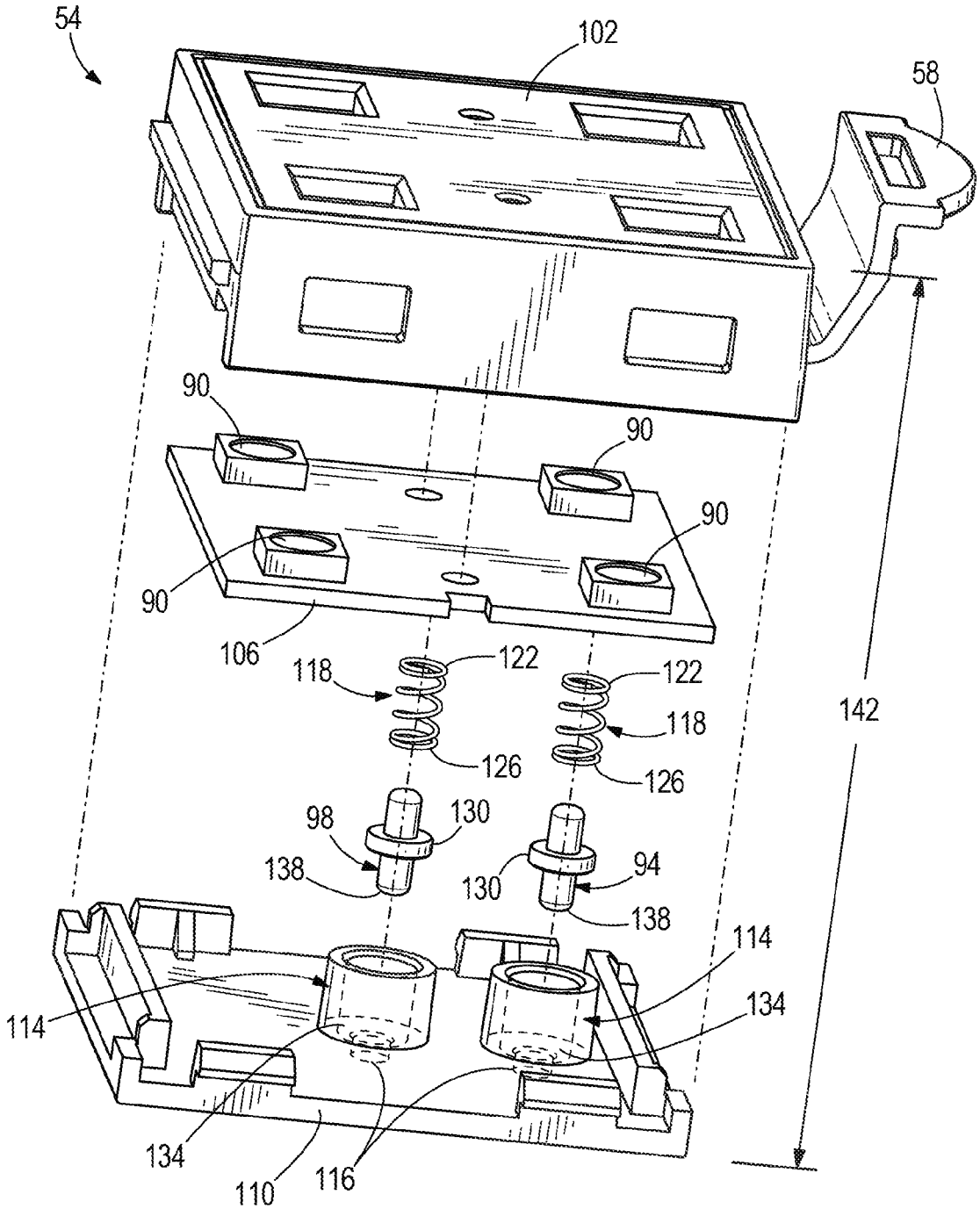
FIG. 8 is an exploded perspective view of the light-emitting module of FIG. 6.

With reference to FIG. 8, each of the modules 54 (and similarly each of the modules 50) includes a bottom side cover plate 102 that fits over the LEDs 90 (or the LEDs 70), a printed circuit board (PCB) 106 that is coupled to both the LEDs 90 (or the LEDs 70) and the electrical connectors 90, 94 (or the electrical connectors 74, 78), and a connection side cover plate 110 that is coupled to the electrical connectors 90, 94 (or the electrical connectors 74, 78).

As illustrated in FIG. 8, the cover plate 110 includes two hollowed-out bosses 114 and two openings 116 adjacent the hollowed-out bosses 114 in the cover plate 110 that receive portions of the electrical connectors 94, 98. The electrical connectors 94, 98 are biased toward the cover plate 110 and the openings 116 by springs 118 that are coupled at first ends 122 to the PCB 106 and at opposite ends 126 to the electrical connectors 94, 98. The electrical connectors 94, 98 include circumferentially extending protrusions 130 that act as stops to engage inner surfaces 134 of the bosses 114 and limit the extent to which the connectors 94, 98 are biased away from the PCB 106. The electrical connectors 94, 98 also include contact ends 138 that extend adjacent the protrusions 130 and are received in the openings 116. The contact ends 138 extend through the openings 116 and engage one or more of the channels 30, 34, 38.

When the electrical connectors 94, 98, (or the electrical connectors 74, 78) contact and engage one or more of the channels 30, 34, 38, the springs 118 press the connectors 94, 98 away from the PCB 106 and press the contact ends 138 into contact with the channels 30, 34, 38 to assure a good electrical connection.

In some constructions a single module is used in place of the separate modules 50, 54. The single module emits both white and blue light (e.g., with various LEDs), and is coupled to both control channels 30, 34. A manual intensity control is provided on a bottom side, for example, of the single module to fine tune color temperature emitting from the single module.

In some constructions one or more of the modules 50, 54 include narrow incident angle LEDs 70, 90 that are able to be rotated or are otherwise able to be have their light directed toward a focal point or points within an aquarium. In some constructions one or more of the modules 50, 54 incorporate wide angle LED's 70, 90 for a "flood" light effect. In some constructions one or more of the modules 50, 54 include optical elements (e.g., lenses, etc.) that change angles of the light emitted from the LEDs 70, 90, diffuse the light, and/or focus the light. In some constructions the optical elements are removable. The optical elements are removable while the light element 10 is in place (e.g. while the light element 10 is coupled to an aquarium). In some constructions the optical elements snap onto the modules 50, 54.

In some constructions, one or more of the modules 50, 54 include just one LED color temperature (e.g., all white or all blue) or a combination of LED types for a desired effect in the aquarium.

In some constructions one or more of the modules 50, 54 include a multitude of different LED types other than just blue and white LEDs, such as red/white or others.

In some constructions one or more of the modules 50, 54 are heat-sinked so as to be able to modulate temperatures at the diode levels or include mechanical couplings such that the heat sinks for the LED modules are contained in the light element 10 itself rather than within the modules 50, 54.

With reference to FIG. 8, each module 50 (and similarly each module 54) has a thickness 142, as measured in a direction between the top and bottom sides 62, 66, and perpendicular to both the top and bottoms sides 62, 66, of less than approximately 1.0 inch. In some constructions the thickness 142 is approximately 0.75 inch. Other constructions include different thicknesses for the modules 50, 54.

With continued reference to FIGS. 4-7, each module 50 (and similarly each module 54) is square, and has both a width and a height 146 (not including the tabs 58) of approximately 3.75 inches. In some construction the width and the height 146 are both approximately 2.25 inches. In some constructions both the width and the height 146 are less than approximately 4 inches. Other constructions include different widths and heights for the modules 50, 54, as well as different shapes for the modules 50, 54.

Figure 9:
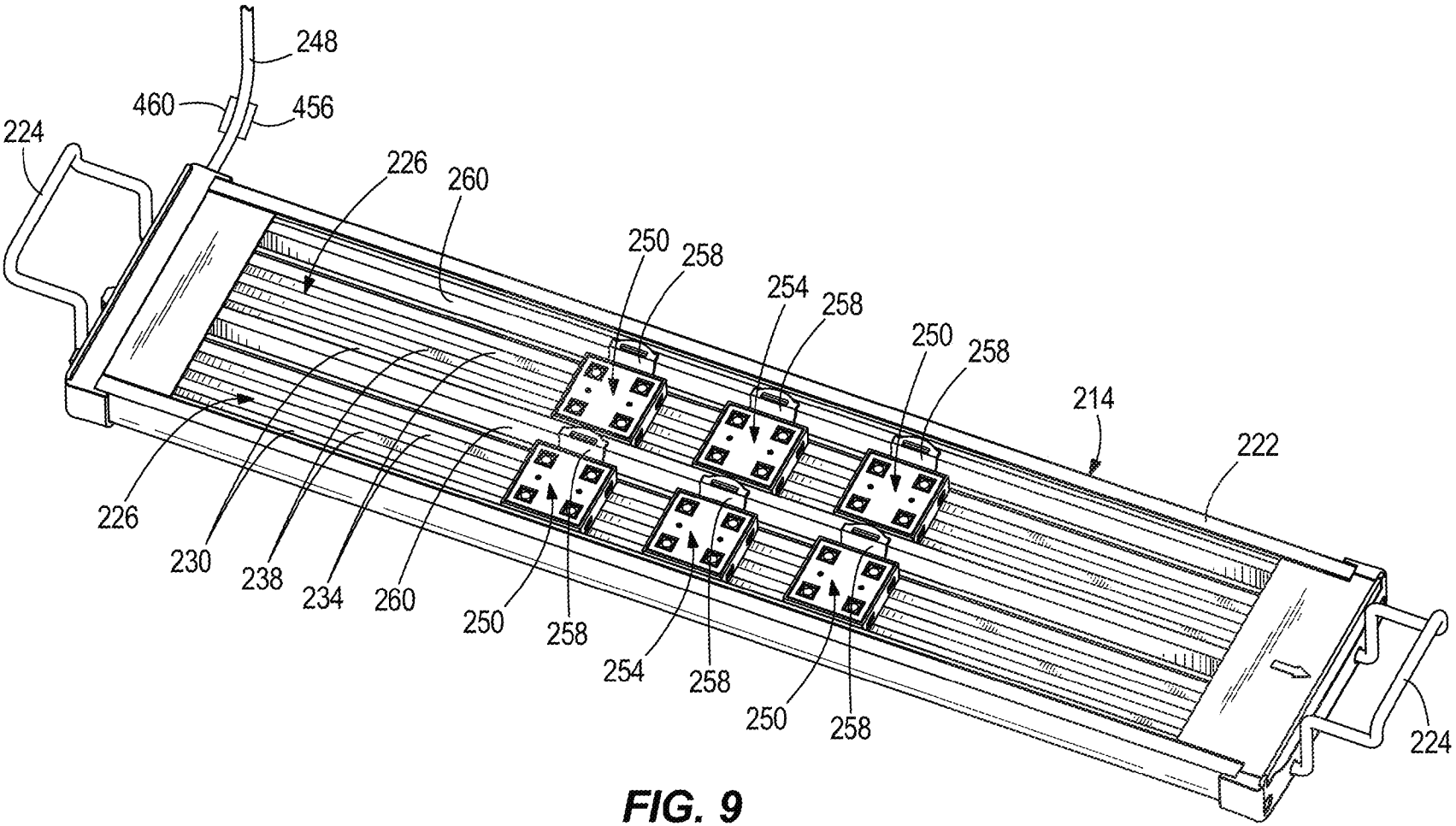
FIG. 9 is a perspective view of a light member according to another construction, illustrating two lighting control regions along a bottom of the light member.

FIG. 9 illustrates a light member 210 that is similar to the light member 10, and includes a housing 214 having a bottom side 222 facing an interior of the aquarium. The bottom side 222 includes two lighting control regions 226. The lighting control regions 226 extend generally linearly in an elongate direction parallel to one another, and include a first control channel 230, a second control channel 234, and a third, neutral channel 238 disposed therein. The third channel 238 is disposed between the first and second channels 230, 234. As with the light member 10, the channels 230 and 234 are control channels for controlling two different types of light within the aquarium. The same channels 230, 234, and 238 run through both of the lighting control regions 226, and are controlled by switches 242, 246.

In some constructions each lighting control region 226 instead includes a separate set of control channels 230, 238 and a neutral channel 234, with one or more switches operable to control the channels 230, 234, 238 within each lighting control region 226. Each of the lighting control regions 226 provides room for coupling of one or more modules (e.g., such as modules 50, 54). In other constructions more than two lighting control regions 226 are provided.

In some constructions, a light member includes two lighting control regions that are coupled to dimmer switches for controlling blue light, and a single lighting control region disposed between the two lighting control regions that is coupled to an on/off switch for controlling white light. Various other combinations of lighting control regions and modules are also possible.

Figure 10:
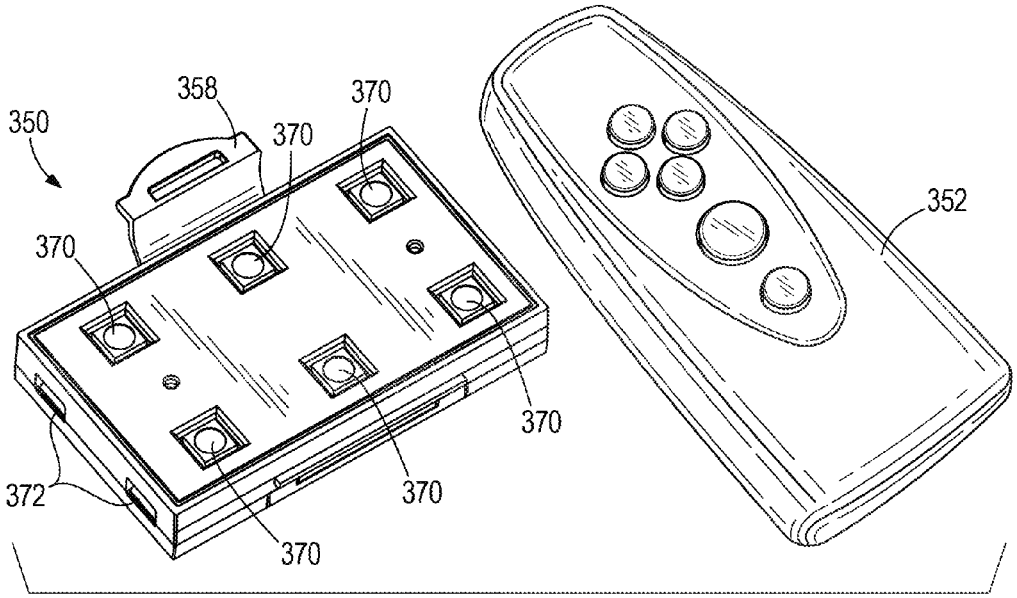
FIG. 10 is a perspective view of a radio frequency (RF) light-emitting module according to another construction, along with a remote control for operating the light-emitting module.

FIG. 10 illustrates a module 350 that includes radio frequency (RF) or other communication/control hardware so as to be controlled remotely by a remote control 352. Typically, the module 350 or other component, such as the light member includes an RF receiver that can receive an RF signal for use in controlling the module 350. In this manner the control channels 30, 34, 230, 234 on the lighting control region 26, 226 supply power to the module 350, but the color, intensity and other functionality are controlled remotely by the remote control 352. The module 350 includes six LEDs 370. In the illustrated construction each of the LEDs 370 is an RGB LED that is capable of emitting varying levels of red, green, or blue light. The RGB LEDs 370 blend red, green, and blue light to create a wide range of colors within the aquarium. When coupled to the light-emitting region 26, 226, the module 350 receives power from the control channel 30, 34, 230, 234 and is controlled remotely by an RF signal from the remote control 352. In some constructions multiple modules 350 are coupled to the lighting control region 26, 226, with each of the modules 350 being controlled by a single remote control 352. The remote control 352 functions include on/off, increase/decrease intensity, color selection, reset (to white light), and auto mode where the module 350 continuously cycles through the different colors. The module 350 also includes inputs 372 for insertion of one or more optics to snap onto the module 350 that change an angle of emitted light from the LEDs 370, or otherwise alter and affect the optics and emission of light from one or more of the LEDs.

Figure 11:
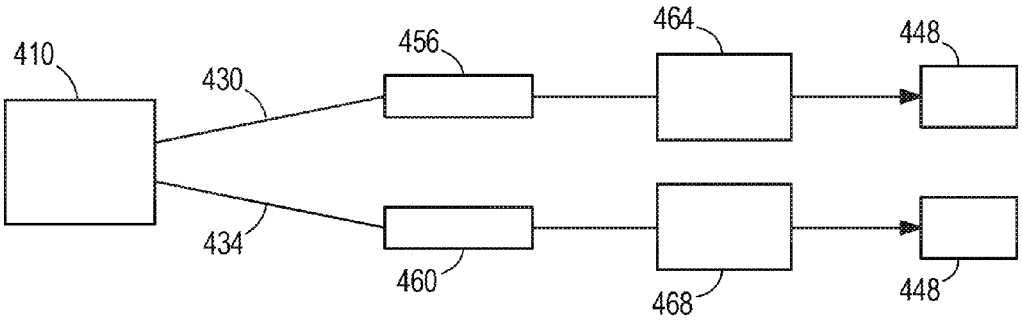
FIG. 11 is a schematic illustration of a dual in-line timer for a light-emitting module.

FIG. 11 schematically illustrates a light member 410 that is controlled with two in-line timers 456, 460. The timer 456 is coupled to a first control channel 430, and the timer 460 is coupled to a second control channel 434. The first and second control channels 430, 434 control white and blue light (or other arrangements), similar to the channels 30, 34, and 230, 234 described above. Each of the timers 456, 460 is coupled to a transformer 464, 468, respectively, and the transformers 464, 468 are coupled to either a single power cord 448 or multiple power cords 448. As illustrated in FIG. 9, the timers 456, 460, are slim, elongate structures that emphasize an "in-line" application with the power supply cord or cords 448.

The in-line timers 456, 460 are digital controllers. The timers 456, 460 allow a user to set a time limit for various colors emitting from one or more modules (e.g., modules 50, 54, 250, 254, 350, etc.) coupled to the light member 410, and are programmable to set on/off times and to gradually ramp power up/down by varying the DC voltage, thereby creating a dimming effect. The timers 456, 460 also have various mode settings allowing a user to manually select an on/off, a timer mode, and a demo/preview mode to preview current settings.

Figure 12:
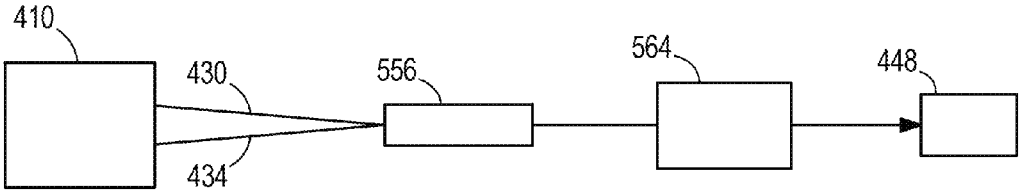
FIG. 12 is a schematic illustration of a single in-line timer for a light-emitting module.
Figure 13:
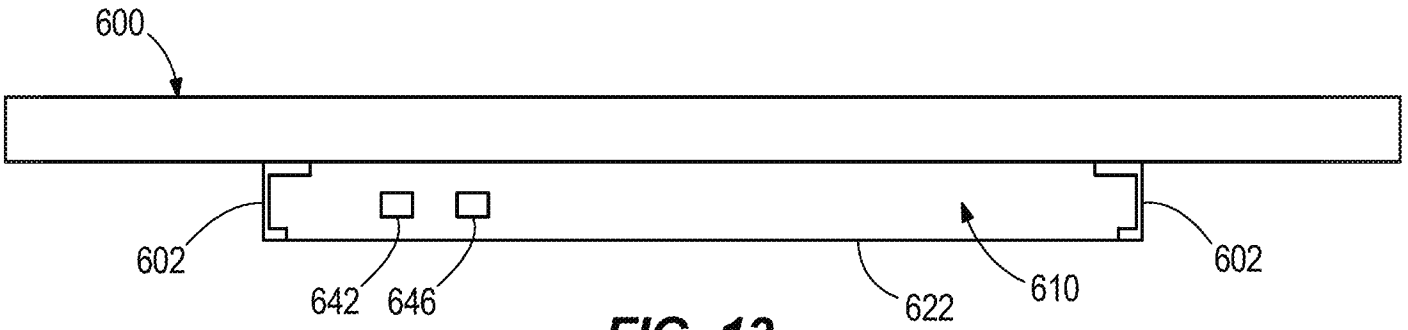
FIG. 13 is a schematic illustration of a cabinet and mounting bracket for insertion of the light member.

FIG. 12 illustrates a single timer 556 that controls both channels 430, 434, and is coupled to a single transformer 564. The timer 556 is also a slim, elongate structure that emphasizes an "in-line" application with the power supply cord 448. Depending on the application, one or more of the timers 456, 460, 556 may be used to control a single channel or multiple channels, setting specific on/off times and/or dimming duration for each channel.

While the light members described above are described in the context of an aquarium, the light members may be used with various other types of enclosures and structures, including underneath office or kitchen cabinets to provide lighting beneath the cabinets.

For example, and with reference to FIGS. 13-16, in some constructions a cabinet 600 includes a bracket 602 that provides a structure by which a light member 610 is coupled to the cabinet 600. The light member 610 may be mounted first to the bracket 602, or the bracket may first be mounted to the cabinet 600. The light member 610 may be identical to one of the light members described above, such as light member 10, or may include different features or structures other than that illustrated for light member 10.

Figure 14:
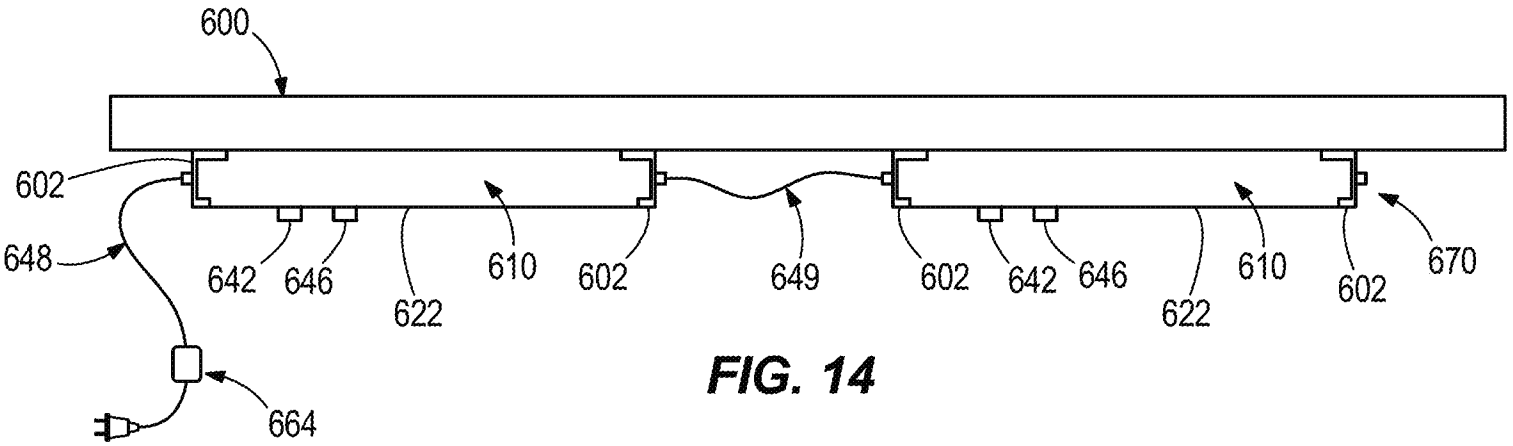
FIG. 14 is a schematic illustration of a series of the light members mounted under a cabinet.

With reference to FIG. 14, in some constructions the light member 610 is coupled together with other light members 610 to provide for a series of light members 610 disposed underneath one or more cabinets. A power cord 648 is disposed at one end of one of the light members 610, and a connector cord 649 is coupled at the opposite end, so as to link together two or more light members 610 in series. As illustrated in FIG. 14, a transformer 664 is additionally provided in conjunction with and coupled to the power cord 648. The transformer 664 is mountable to the bottom of the cabinet 600. One of the light members 610 includes a plug 670 in place of a connector cord 649.

With continued reference to FIGS. 13-16, the light member 610 includes switches 642, 646 (similar to switches 42, 46) that are disposed along either a side (FIG. 13) or bottom (FIG. 14) of the light member 610, to provide for accessible control of one or more modules (e.g., modules 50, 54) on the light member 610.

In some constructions, the modules (or lighting control regions) for the light member 610 are of different size or shape than the modules (or lighting control regions) for the light member 10, such that the modules for the light member 610 are only for use underneath a cabinet in the lighting member 610, and the modules for the light member 10 are only for use with an aquarium on the lighting member 10.

Figure 15:
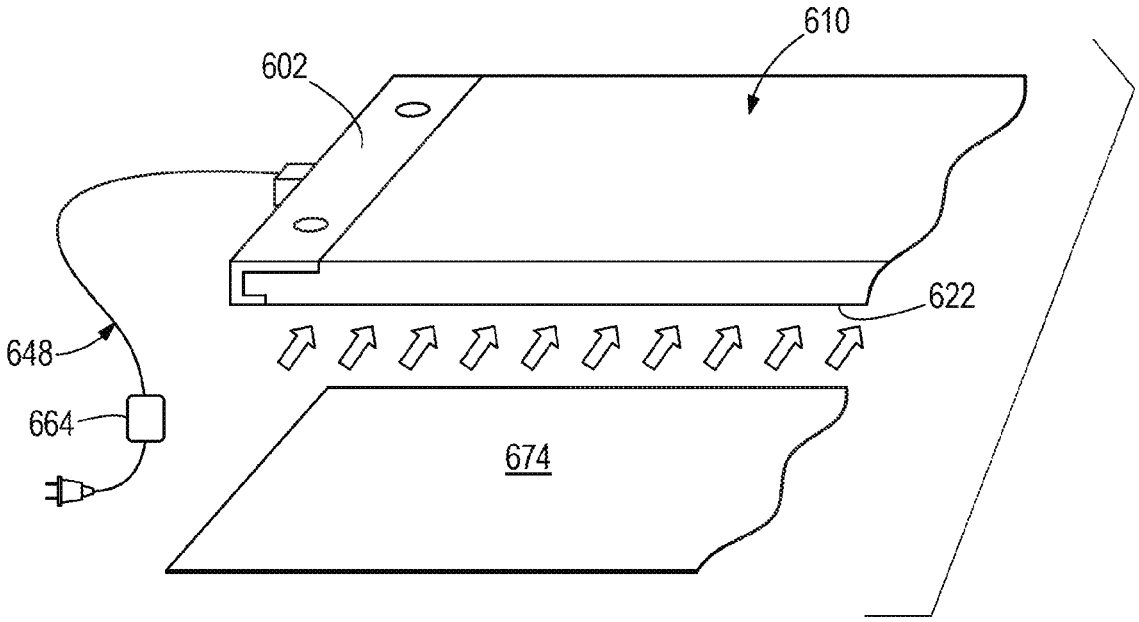
FIGS. 15 and 16 are schematic illustrations of an optical element being added to a light member under a cabinet.
Figure 16:
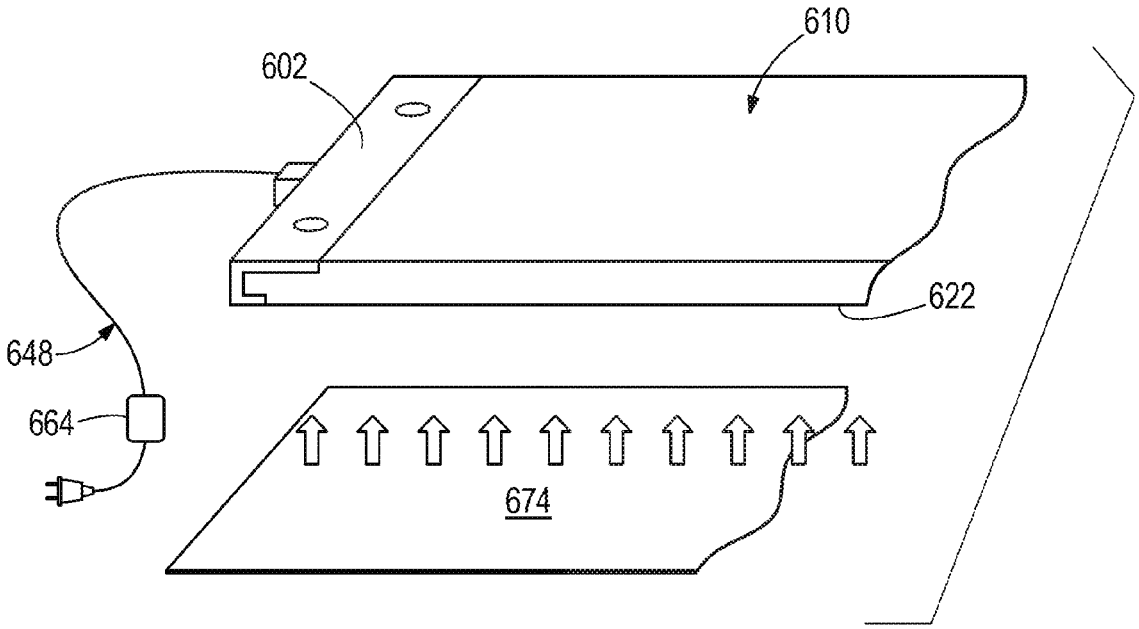

With reference to FIGS. 15 and 16 in some constructions the light member 610 also includes an optics member 674 (e.g., a lens, a diffuser, etc.) that is coupled along a bottom side 622 of the light member 610 either by sliding the optics member 674 along the bottom side 622 in a generally horizontal direction parallel to the bottom side 622 (FIG. 15) or by raising the optics member 674 up to the bottom side 622 and snapping or otherwise coupling the optics 674 in place over the bottom side 622 (and over, for example, one or more modules on the light member 610).

Various features and advantages of the invention are set forth in the following claims.

The invention claimed is:

1. A lighting system comprising:

a housing having a top side and a bottom side, the top side facing away from a space to be lit, and the bottom side facing the space to be lit;

a lighting control region disposed on the bottom side of the housing that illuminates the space to be lit, the lighting control region having an elongate recess, the lighting control region also having a first control channel, a second control channel, and a third channel, each of the first and second control channels and the third channel extending length-wise along a direction of the lighting control region;

a light-emitting module configured to be releasably coupled to the housing within the elongate recess such that the light-emitting module is electrically connected to the first control channel and emits blue light and such that the light-emitting module extends over each of the first control channel, the second control channel, and the third channel, wherein the light-emitting module includes a flexible tab to releasably couple the light-emitting module to the housing; and a switch assembly coupled to the housing and operable to selectively deliver power to the light-emitting module.

2. The lighting system of claim 1, wherein the light-emitting module is sized and shaped such that the light-emitting module is electrically connected to the first control channel and the third channel but not the second control channel when the light-emitting module is coupled to the housing.

3. The lighting system of claim 1, further comprising a bracket coupled to the housing, wherein the bracket is configured to couple the lighting system to an underside of an office or kitchen cabinet.

4. An aquarium comprising:

a housing defining an interior; and the lighting system of claim 1, wherein the bottom side of the housing faces the interior.

5. The lighting system of claim 1, wherein the housing is a first housing and the lighting control region is a first lighting control region, and further comprising a second housing having a top side and a bottom side, the top side of the second housing facing away from the space to be lit, and the bottom side of the second housing facing the space to be lit, and a second lighting control region disposed on the bottom side of the second housing that illuminates the space to be lit, and a connector cord extending between the first and second housings to couple the first and second housings in series.

6. The lighting system of claim 1, further comprising a first timer coupled to the first control channel, wherein the first timer controls time limits for emission of light from the light-emitting module.

7. The lighting system of claim 6, wherein the first timer is programmed to set off/on times and to ramp power up and down to the first control channel.

8. The lighting system of claim 6, wherein the first timer is coupled to both the first control channel and the second control channel.

9. The lighting system of claim 1, wherein the first control channel is associated with blue light, and the second control channel is associated with white light.

10. The lighting system of claim 9, wherein the light-emitting module is a first light-emitting module, and further comprising a second light emitting module configured to be releasably coupled to the housing within the elongate recess such that the second light-emitting module is electrically connected to the second control channel and emits white light.

11. A lighting system comprising:

a housing having a top side and a bottom side, the top side facing away from a space to be lit, and the bottom side facing the space to be lit;

a lighting control region disposed on the bottom side of the housing that illuminates the space to be lit, the lighting control region having an elongate recess, the lighting control region also having a first control channel, a second control channel, and a third channel, each of the first and second control channels and the third channel extending length-wise along a direction of the lighting control region;

a light-emitting module configured to be releasably, wirelessly coupled to the housing within the elongate recess such that the light-emitting module is electrically connected to the first control channel and emits blue light and such that the light-emitting module extends over each of the first control channel, the second control channel, and the third channel; and a switch assembly coupled to the housing and operable to selectively deliver power to the light-emitting module.

12. The lighting system of claim 11, wherein the light-emitting module is sized and shaped such that the light-emitting module is electrically connected to the first control channel and the third channel but not the second control channel when the light-emitting module is coupled to the housing.

13. The lighting system of claim 11, further comprising a bracket coupled to the housing, wherein the bracket is configured to couple the lighting system to an underside of an office or kitchen cabinet.

14. An aquarium comprising:

a housing defining an interior; and the lighting system of claim 11, wherein the bottom side of the housing faces the interior.

15. The lighting system of claim 11, wherein the housing is a first housing and the lighting control region is a first lighting control region, and further comprising a second housing having a top side and a bottom side, the top side of the second housing facing away from the space to be lit, and the bottom side of the second housing facing the space to be lit, and a second lighting control region disposed on the bottom side of the second housing that illuminates the space to be lit, and a connector cord extending between the first and second housings to couple the first and second housings in series.

16. The lighting system of claim 11, further comprising a first timer coupled to the first control channel, wherein the first timer controls time limits for emission of light from the light-emitting module.

17. The lighting system of claim 16, wherein the first timer is programmed to set off/on times and to ramp power up and down to the first control channel.

18. The lighting system of claim 16, wherein the first timer is coupled to both the first control channel and the second control channel.

19. The lighting system of claim 11, wherein the first control channel is associated with blue light, and the second control channel is associated with white light.

20. The lighting system of claim 19, wherein the light-emitting module is a first light-emitting module, and further comprising a second light emitting module configured to be releasably coupled to the housing within the elongate recess such that the second light-emitting module is electrically connected to the second control channel and emits white light.

* * * * *